US008723775B2

(12) United States Patent
Yamato et al.

(10) Patent No.: US 8,723,775 B2
(45) Date of Patent: May 13, 2014

(54) METHOD FOR DRIVING LIQUID CRYSTAL DISPLAY APPARATUS

(71) Applicants: Asahi Yamato, Tokyo (JP); Yuki Kawashima, Koshigaya (JP); Kiyoshi Nakagawa, Yokohama (JP); Kohzoh Takahashi, Tokyo (JP); Toshihiro Yanagi, Nara (JP)

(72) Inventors: Asahi Yamato, Tokyo (JP); Yuki Kawashima, Koshigaya (JP); Kiyoshi Nakagawa, Yokohama (JP); Kohzoh Takahashi, Tokyo (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/799,981

(22) Filed: Mar. 13, 2013

(65) Prior Publication Data

US 2013/0194320 A1 Aug. 1, 2013

Related U.S. Application Data

(60) Continuation of application No. 13/488,801, filed on Jun. 5, 2012, now Pat. No. 8,462,091, which is a division of application No. 11/887,220, filed as application No. PCT/JP2006/302076 on Feb. 7, 2006, now Pat. No. 8,217,880.

(30) Foreign Application Priority Data

Mar. 31, 2005 (JP) ..... 2005-104862

(51) Int. Cl.
*G09G 3/36* (2006.01)

(52) U.S. Cl.
USPC ..... 345/94; 345/89; 345/690

(58) Field of Classification Search
USPC ..... 345/87–102, 204, 690–699
See application file for complete search history.

(56) References Cited

U.S. PATENT DOCUMENTS

| | | | |
|---|---|---|---|
| 5,034,986 | A | 7/1991 | Karmann et al. |
| 5,465,102 | A | 11/1995 | Usui et al. |
| 6,496,194 | B1 | 12/2002 | Mikoshiba et al. |
| 6,661,488 | B1 | 12/2003 | Takeda et al. |
| 7,113,227 | B1 | 9/2006 | Kakuya et al. |
| 2001/0033691 | A1 | 10/2001 | Kimura |
| 2002/0011979 | A1 | 1/2002 | Nitta et al. |
| 2002/0011998 | A1 | 1/2002 | Tamura |
| 2002/0021395 | A1 | 2/2002 | Koma et al. |

(Continued)

FOREIGN PATENT DOCUMENTS

| | | |
|---|---|---|
| EP | 0 662 767 | 12/1995 |
| JP | 9-106262 | 4/1997 |

(Continued)

OTHER PUBLICATIONS

U.S. Restriction Requirement dated Jul. 9, 2010 for U.S. Appl. No. 11/887,220.

(Continued)

*Primary Examiner* — Stephen Sherman
(74) *Attorney, Agent, or Firm* — Harness, Dickey & Pierce, P.L.C.

(57) ABSTRACT

In one embodiment of the present invention, when a still image is displayed, applied voltages respectively corresponding to a total of n (n being an integer of not less than 4) types of gradation 0 to (n−1) are outputted to pixels. When a moving image is displayed, an applied voltage corresponding to a predetermined gradation m (1≤m≤(n−2)) is applied to the pixels instead of applied voltages respectively corresponding to gradations of less than the predetermined gradation m. Overdrive driving is performed with respect to a total of n types of gradation.

9 Claims, 10 Drawing Sheets

(56) References Cited

U.S. PATENT DOCUMENTS

| | | | |
|---|---|---|---|
| 2002/0027551 | A1 | 3/2002 | Nitta et al. |
| 2002/0036717 | A1 | 3/2002 | Abiko et al. |
| 2002/0140658 | A1 | 10/2002 | Takatori |
| 2002/0190940 | A1 | 12/2002 | Itoh et al. |
| 2003/0142055 | A1 | 7/2003 | Iisaka |
| 2004/0183820 | A1 | 9/2004 | Kawahara et al. |
| 2004/0201564 | A1 | 10/2004 | Sugino et al. |
| 2004/0263495 | A1 | 12/2004 | Sugino et al. |
| 2005/0024546 | A1 | 2/2005 | Kubo et al. |
| 2005/0162360 | A1 | 7/2005 | Ishihara et al. |
| 2005/0225522 | A1 | 10/2005 | Wu et al. |
| 2005/0248524 | A1 | 11/2005 | Feng et al. |
| 2006/0017678 | A1 | 1/2006 | Shiomi |
| 2006/0028419 | A1 | 2/2006 | Lee et al. |
| 2009/0079682 | A1 | 3/2009 | Yamato et al. |

FOREIGN PATENT DOCUMENTS

| | | |
|---|---|---|
| JP | 10-97227 | 4/1998 |
| JP | 11-45078 | 2/1999 |
| JP | 11-109391 | 4/1999 |
| JP | 11-258605 | 9/1999 |
| JP | 2000-221475 | 8/2000 |
| JP | 2000-330542 | 11/2000 |
| JP | 2001-175237 | 6/2001 |
| JP | 2002-72169 | 3/2002 |
| JP | 2002-131721 | 5/2002 |
| JP | 2003-186446 | 7/2003 |
| JP | 2003-207762 | 7/2003 |
| JP | 2004-78129 | 3/2004 |
| JP | 2004-334010 | 11/2004 |
| JP | 2005-70799 | 3/2005 |
| TW | 548477 | 8/2003 |
| TW | 550412 | 9/2003 |
| WO | WO 03077013 A2 | 9/2003 |

OTHER PUBLICATIONS

U.S. Office Action dated Sep. 2, 2010 for U.S. Appl. No. 11/887,220.
U.S. Office Action dated Jan. 6, 2011 for U.S. Appl. No. 11/887,220.
U.S. Office Action dated May 2, 2011 for U.S. Appl. No. 11/887,220.
U.S. Advisory Action dated Aug. 23, 2011 for U.S. Appl. No. 11/887,220.
U.S. Office Action dated Oct. 18, 2011 for U.S. Appl. No. 11/887,220.
U.S. Office Action dated Feb. 3, 2012 for U.S. Appl. No. 11/887,220.
U.S. Notice of Allowance dated Mar. 5, 2012 for U.S. Appl. No. 11/887,220.
U.S. Office Action dated Feb. 7, 2011.
U.S. Office Action dated Feb. 3, 2012 for U.S. Appl. No. 11/886,958.
U.S. Office Action dated Oct. 15, 2008 for U.S. Appl. No. 11/183,994.
U.S. Office Action dated May 12, 2009 for U.S. Appl. No. 11/183,994.
U.S. Advisory Action dated Jul. 29, 2009 for U.S. Appl. No. 11/183,994.
U.S. Notice of Panel Decision dated Sep. 28, 2009 for U.S. Appl. No. 11/183,994.
U.S. Notice of Allowance dated Oct. 13, 2010 for U.S. Appl. No. 11/183,994.
U.S. Office Action dated Jul. 7, 2010 for U.S. Appl. No. 11/886,958.
U.S. Office Action dated Oct. 29, 2010 for U.S. Appl. No. 11/886,958.
U.S. Advisory Action dated Apr. 15, 2011 for U.S. Appl. No. 11/886,958.
U.S. Office Action dated Oct. 18, 2011 for U.S. Appl. No. 11/886,958.
International Search Report dated Apr. 4, 2006.
U.S. Notice of Allowance mailed May 14, 2012 for corresponding U.S. Appl. No. 11/886,958.
U.S. Notice of Allowance mailed Mar. 18, 2013 for corresponding U.S. Appl. No. 13/488,801.

FIG. 7

BLACK PROCESSING METHOD IN CASES WHERE n=256 AND m=31

| ORIGINAL DATA | | CONVERTED DATA | | | | | |
|---|---|---|---|---|---|---|---|
| | | FIRST METHOD | | SECOND METHOD | | THIRD METHOD | |
| GRADA-TION | LIQUID CRYSTAL APPLIED VOLTAGE | GRADA-TION | LIQUID CRYSTAL APPLIED VOLTAGE | GRADA-TION | LIQUID CRYSTAL APPLIED VOLTAGE | GRADA-TION | LIQUID CRYSTAL APPLIED VOLTAGE |
| 0 | 1.00V | 31 | 1.31V | 31 | 1.31V | 0 | 1.310V |
| 1 | 1.01V | 31 | 1.31V | 32 | 1.32V | 1 | 1.309V |
| 2 | 1.02V | 31 | 1.31V | 33 | 1.33V | 2 | 1.319V |
| 3 | 1.03V | 31 | 1.31V | 34 | 1.34V | 3 | 1.329V |
| 4 | 1.04V | 31 | 1.31V | 35 | 1.35V | 4 | 1.339V |
| 5 | 1.05V | 31 | 1.31V | 35 | 1.35V | 5 | 1.348V |
| ⋮ | | ⋮ | | ⋮ | | ⋮ | |
| 29 | 1.29V | 31 | 1.31V | 56 | 1.56V | 29 | 2.590V |
| 30 | 1.30V | 31 | 1.31V | 57 | 1.57V | 30 | 2.599V |
| 31 | 1.31V | 31 | 1.31V | 58 | 1.58V | 31 | 2.619V |
| 32 | 1.32V | 32 | 1.32V | 59 | 1.59V | 32 | 2.639V |
| 33 | 1.33V | 33 | 1.33V | 60 | 1.60V | 33 | 2.659V |
| 34 | 1.34V | 34 | 1.34V | 61 | 1.61V | 34 | 2.678V |
| 35 | 1.35V | 35 | 1.35V | 62 | 1.62V | 35 | 2.688V |
| 36 | 1.36V | 36 | 1.36V | 63 | 1.63V | 36 | 2.698V |
| 37 | 1.37V | 37 | 1.37V | 64 | 1.64V | 37 | 2.708V |
| 38 | 1.38V | 38 | 1.38V | 64 | 1.64V | 38 | 2.718V |
| 39 | 1.39V | 39 | 1.39V | 65 | 1.65V | 39 | 2.728V |
| ⋮ | | ⋮ | | ⋮ | | ⋮ | |
| 240 | 3.40V | 240 | 3.40V | 242 | 3.42V | 240 | 3.405V |
| 241 | 3.41V | 241 | 3.41V | 243 | 3.43V | 241 | 3.415V |
| 242 | 3.42V | 242 | 3.42V | 244 | 3.44V | 242 | 3.425V |
| 243 | 3.43V | 243 | 3.43V | 244 | 3.44V | 243 | 3.435V |
| 244 | 3.44V | 244 | 3.44V | 245 | 3.45V | 244 | 3.444V |
| 245 | 3.45V | 245 | 3.45V | 246 | 3.46V | 245 | 3.454V |
| 246 | 3.46V | 246 | 3.46V | 247 | 3.47V | 246 | 3.464V |
| 247 | 3.47V | 247 | 3.47V | 248 | 3.48V | 247 | 3.473V |
| 248 | 3.48V | 248 | 3.48V | 249 | 3.49V | 248 | 3.483V |
| 249 | 3.49V | 249 | 3.49V | 250 | 3.50V | 249 | 3.492V |
| 250 | 3.50V | 250 | 3.50V | 251 | 3.51V | 250 | 3.502V |
| 251 | 3.51V | 251 | 3.51V | 251 | 3.51V | 251 | 3.511V |
| 252 | 3.52V | 252 | 3.52V | 252 | 3.52V | 252 | 3.521V |
| 253 | 3.53V | 253 | 3.53V | 253 | 3.53V | 253 | 3.531V |
| 254 | 3.54V | 254 | 3.54V | 254 | 3.54V | 254 | 3.541V |
| 255 | 3.55V | 255 | 3.55V | 255 | 3.55V | 255 | 3.550V |

LIQUID CRYSTAL APPLIED VOLTAGES RESPECTIVELY CORRESPONDING TO GRADATIONS OF NOT LESS THAN m ARE THE SAME AS IN ORIGINAL DATA

OVERLAPPED GRADATIONS: n GRADATIONS EXPRESSED IN PSEUDO MANNER WITH USE OF (n-m) DATA

SMOOTH GRADATIONS: n GRADATIONS RECREATED WITHIN RANGE OF m TO (n-1)

-----:ORIGINAL GRADATION-LUMINANCE CHARACTERISTIC
———:GRADATION-LUMINANCE CHARACTERISTIC EXHIBITED AFTER GRADATIONS HAVE BEEN CORRECTED FOR MOVING IMAGE
—·—·-:GRADATION-LUMINANCE CHARACTERISTIC EXHIBITED AFTER CORRECTION FOR MOVING IMAGE AND BACKLIGHT ADJUSTMENT

——— :GRADATION-LUMINANCE CHARACTERISTIC EXHIBITED AFTER CORRECTION FOR MOVING IMAGE AND BACKLIGHT ADJUSTMENT (=ORIGINAL GRADATION-LUMINANCE CHARACTERISTIC)

----- :GRADATION-LUMINANCE CHARACTERISTIC EXHIBITED AFTER GRADATION CORRECTION FOR MOVING IMAGE

METHOD FOR DRIVING LIQUID CRYSTAL DISPLAY APPARATUS

CROSS-REFERENCE TO RELATED APPLICATIONS

This application is a Continuation of U.S. application Ser. No. 13/488,801 filed Jun. 5, 2012, which is a Divisional of U.S. application Ser. No. 11/887,220 filed Sep. 27, 2007, which claims priority under 35 U.S.C. §§120, 121 to PCT Application No. PCT/JP2006/302076, filed Feb. 7, 2006, which claims priority to Japanese Application No. 2005-104862, filed Mar. 31, 2005, the entire contents of each of which are herein incorporated by reference.

TECHNICAL FIELD

The present invention relates to methods for driving liquid crystal display apparatuses. Particularly, the present invention relates to a method for driving a liquid crystal display apparatus, which method makes it possible to achieve an improvement in response speed at which a moving image is displayed.

BACKGROUND ART

Conventionally, a liquid crystal display apparatus has had a problem of low response speed. That is, a change in display gradation of the liquid crystal display apparatus is such that: a change in orientation state of liquid crystal molecules is made by making a change in voltage applied to a liquid crystal layer, so that the transmittance of a display pixel is changed. Moreover, the low response speed of the liquid crystal display apparatus is attributed to the fact that it takes a long time to complete the change caused in orientation state of the liquid crystal molecules in response to the change in voltage applied to the liquid crystal layer.

In recent years, liquid crystal display apparatuses such as liquid crystal televisions, portable televisions, and portable game machines have had increased opportunities to display high-definition moving images with liquid crystals, and therefore have been increasingly required to respond at high speeds. On the other hand, high-quality picture technologies often cause a decrease in response speed simultaneously (e.g., AVS and mobile AVS).

As disclosed in Japanese Unexamined Patent Application Publication No. 78129/2004 (Tokukai 2004-78129; published on Mar. 11, 2004), a known example of a method for attempting to improve response speed is a method for emphasizing a transitional gradation by performing overdrive driving. That is, as shown in FIG. 12, the overdrive driving is such that when the initial luminance A of the initial gradation 0 is changed to the target luminance C of the target gradation 64, a voltage corresponding to the excessive luminance B, which is higher than the target luminance C, is initially applied to the liquid crystals only for a short time. This causes a high voltage to be applied to the liquid crystals, thereby making it possible to reduce the response time it takes to attain the target luminance C.

However, as shown in FIG. 9, such a method causes deterioration in image quality. Examples of such deterioration in image quality include a so-called angular response (two-step response) which, before the target luminance C is attained, emerges as a sharp corner indicating the excessive luminance B, which is higher than the target luminance C. The presence of such a corner indicating a luminance higher than the target luminance C causes an image to instantaneously look whitish.

Since this is very conspicuously identified, it is necessary that the driving be performed so that no such corner emerges.

However, a change in overdrive amount only causes a change in size of the left angular portion, and does not result in an improvement in the right sloping portion. Therefore, there is no improvement in display. Further, as described above, an excessive overdrive amount causes a strikingly white display to be produced at the angular portion, thereby causing deterioration in display quality.

Furthermore, even when the overdrive driving is performed, a sufficient speed may not be able to be obtained in a low-gradation region due to the aforementioned low response speed.

That is, the aforementioned low response speed of a liquid crystal display apparatus is not seen uniformly all over the gradation-level regions, but is such that the response speed becomes extremely low in part of the gradation regions. For example, the response speed of a vertically-aligned and normally black liquid crystal display apparatus (mobile ASV) is extremely low at a rising edge from a low gradation (black display) to an intermediate gradation. Further, the response speed of a normally white liquid crystal display apparatus (mobile ASV) is extremely low in a transition from a high gradation (white display) to an intermediate gradation. These low response speeds cause display problems such as residual images.

In view of this, for example, Japanese Unexamined Patent Application Publication No. 131721/2002 (Tokukai 2002-131721; published on May 9, 2002) discloses a method for improving response speed by carrying out a display without using a gradation level at which the response speed becomes low. Specifically, the liquid crystal driving method of Patent Document 2 tries not to use a gradation level, ranging from a high gradation (white display) to an intermediate gradation, at which the response speed of a normally white system becomes low. Note that a voltage so applied to liquid crystals to be used for driving a liquid crystal display apparatus is usually represented by a gradation-luminance curve shown in FIG. 13.

However, according to the conventional method of Tokukai 2002-131721 for driving a liquid crystal display apparatus, the initial voltage is increased by a predetermined voltage when a gradation level at which the response speed becomes low is not used. Therefore, when a still image is displayed, it is impossible to use a normal luminance characteristic represented by the gradation-luminance curve of FIG. 13.

The present invention has been made in view of the foregoing problems, and it is an object of the present invention to provide a method for driving a liquid crystal display apparatus, which method makes it possible to prevent deterioration in display quality of both a still image and a moving image and to achieve an improvement in response speed at which a moving image is displayed.

DISCLOSURE OF INVENTION

In order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); and when a moving image is displayed, (i) outputting an applied voltage to the pixels instead of applied voltages respectively corresponding to gradations of less than a predetermined gradation m ($1 \leq m \leq (n-2)$) and (ii) performing overdrive driving with respect to the total of n types of gradations, the applied voltage corresponding to the predetermined gradation m.

According to the foregoing invention, normal gradations can be displayed when a still image is displayed. On the other hand, when a moving image is displayed, an applied voltage corresponding to a predetermined gradation m ($1 \leq m \leq (n-2)$) is applied to pixels instead of applied voltages respectively corresponding to gradations of less than the predetermined gradation. Therefore, the applied voltages respectively corresponding to the gradations of less than the predetermined gradation m are not used. This makes it possible to achieve an improvement in response speed.

Furthermore, the present invention performs overdrive driving with respect to the total of n (n being an integer of not less than 4) types of gradation. Therefore, the applied voltages respectively corresponding to the gradations of less than the predetermined gradation m are not used when overdrive driving is performed. This makes it possible to prevent a so-called angular response.

This makes it possible to provide a method for driving a liquid crystal display apparatus, which method makes it possible to prevent deterioration in display quality of both a still image and a moving image and to achieve an improvement in response speed at which a moving image is displayed.

Further, in order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); when a moving image is displayed, without using applied voltages respectively corresponding to gradations of less than a predetermined gradation m ($1 \leq m \leq (n-2)$), overlapping (n−m) types of gradation partially so that n gradations are obtained and then sorting the n gradations into a range of (i) an applied voltage corresponding to the predetermined gradation m to (ii) an applied voltage corresponding to the gradation (n−1); and when an applied voltage corresponding to a gradation k (k being an integer of 0 to (n−1)) obtained by the sorting is applied to the pixels, performing overdrive driving with respect to the total of n (n being an integer) types of gradation.

According to the foregoing invention, the applied voltages respectively corresponding to the gradations of less than the predetermined gradations m ($1 \leq m \leq (n-2)$) are not used when a moving image is displayed. As a result, a low-gradation display is not carried out in a normally black system. This causes a range of luminances that can be displayed to be narrower than when normal display driving is performed, thereby causing deterioration in display quality.

In view of this, the present invention overlaps (n−m) types of gradation partially so that n gradations are obtained and then sorts the n gradations into a range of (i) an applied voltage corresponding to the predetermined gradation m to (ii) an applied voltage corresponding to the gradation (n−1). Therefore, even when the applied voltages respectively corresponding to the gradations of less than the predetermined gradation m are not used, the n gradations can be expressed. This makes it possible to prevent deterioration in display quality. Further, since the overdrive driving is performed, the response speed is increased.

Further, in order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); when a moving image is displayed, without using applied voltages respectively corresponding to gradations of less than a predetermined gradation m ($1 \leq m \leq (n-2)$), redividing the total of n types of gradation within a range of the predetermined gradation m to a gradation (n−1); and when an applied voltage corresponding to a gradation p (p being an integer of 0 to (n−1)) obtained by the redivision is applied to the pixels, performing overdrive driving with respect to the total of n types of gradation.

According to the foregoing invention, the applied voltages respectively corresponding to the gradations of less than the predetermined gradations m ($1 \leq m \leq (n-2)$) are not used when a moving image is displayed. As a result, a low-gradation display is not carried out in a normally black system. This causes a range of luminances that can be displayed to be narrower than when normal display driving is performed, thereby causing deterioration in display quality.

In view of this, the present invention redivides the total of n types of gradation within a range of the predetermined gradation m to a gradation (n−1). Therefore, even when the applied voltages respectively corresponding to the gradations of less than the predetermined gradation m are not used, the n gradations can be expressed. This makes it possible to prevent deterioration in display quality. Further, since the overdrive driving is performed, the response speed is increased.

Further, in order to solve the foregoing problems, a method of the present invention for driving a liquid crystal display apparatus includes the steps of: when a still image is displayed, outputting still-image applied voltages to pixels, the still-image applied voltages respectively corresponding to a total of n (n being an integer of not less than 4) types of gradation 0 to (n−1); when a moving image is displayed, without using applied voltages respectively corresponding to gradations of less than a predetermined gradation m ($1 \leq m \leq (n-2)$), (i) outputting, to the pixels, applied voltages, corresponding to a range of the gradation 0 to a gradation (n−1), which are obtained by adding, to each of the still-image applied voltages, an applied voltage corresponding to the predetermined gradation m, and (ii) performing overdrive driving with respect to the total of n types of gradation.

According to the foregoing invention, the applied voltages respectively corresponding to the gradations of less than the predetermined gradations m ($1 \leq m \leq (n-2)$) are not used when a moving image is displayed. As a result, a low-gradation display is not carried out in a normally black system. This causes a range of luminances that can be displayed to be narrower than when normal display driving is performed, thereby causing deterioration in display quality.

In view of this, the present invention outputs, to the pixels, applied voltages corresponding to a range of the gradation 0 to a gradation (n−1), the applied voltages being obtained by adding, to each of the still-image applied voltages, an applied voltage corresponding to the predetermined gradation m. Therefore, even when the applied voltages respectively corresponding to the gradations of less than the predetermined gradation m are not used, n gradations can be expressed. This makes it possible to prevent deterioration in display quality. Further, since the overdrive driving is performed, the response speed is increased.

Further, in order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); and when a moving image is displayed, (i) outputting an applied voltage to the pixels instead of applied voltages respectively corresponding to gradations of not less than a predetermined gradation q ($1 \leq q \leq (n-1)$) and (ii) performing overdrive driving with respect to the total of n types of gradation, the applied voltage corresponding to the predetermined gradation q.

Further, in order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); when a moving image is displayed, without using applied voltages respectively corresponding to gradations of not less than a predetermined gradation q ($1 \leq q \leq (n-1)$), overlapping (n−q) types of gradation partially so that n gradations are obtained and sorting the n gradations into a range of an applied voltage corresponding to the predetermined gradation q−1 to an applied voltage corresponding to the gradation 0; and when an applied voltage corresponding to a gradation k (k being an integer of 0 to (n−1)) obtained by the sorting is applied to the pixels, performing overdrive driving with respect to the total of n types of gradation.

Further, in order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); when a moving image is displayed, without using applied voltages respectively corresponding to gradations of not less than a predetermined gradation q ($1 \leq q \leq (n-1)$), redividing the total of n types of gradation within a range of the predetermined gradation q−1 to a gradation 0; and when an applied voltage corresponding to a gradation p (p being an integer of 0 to (n−1)) obtained by the redivision is applied to the pixels, performing overdrive driving with respect to the total of n types of gradation.

Further, in order to solve the foregoing problems, a method of the present invention for driving a liquid crystal display apparatus includes the steps of: when a still image is displayed, outputting still-image applied voltages to pixels, the still-image applied voltages respectively corresponding to a total of n (n being an integer of not less than 4) types of gradation 0 to (n−1); when a moving image is displayed, without using applied voltages respectively corresponding to gradations of not less than a predetermined gradation q ($1 \leq q \leq (n-1)$), (i) outputting, to the pixels, applied voltages, corresponding to a range of the gradation 0 to a gradation (n−1), which are obtained by adding, to each of the still-image applied voltages, an applied voltage corresponding to the predetermined gradation q, and (ii) performing overdrive driving with respect to the total of n types of gradation.

Additional objects, features, and strengths of the present invention will be made clear by the description below. Further, the advantages of the present invention will be evident from the following explanation in reference to the drawings.

BRIEF DESCRIPTION OF DRAWINGS

FIG. 4(*b*) is a waveform chart showing a liquid-crystal response waveform obtained from FIG. 5(*a*).

FIG. 7 is a diagram showing converted gradations and liquid crystal applied voltages each used when first to third methods are employed in the liquid crystal display apparatus.

BEST MODE FOR CARRYING OUT THE INVENTION

[Embodiment 1]

An embodiment of the present invention will be described below with reference to FIGS. 1 to 9.

Figure 2:
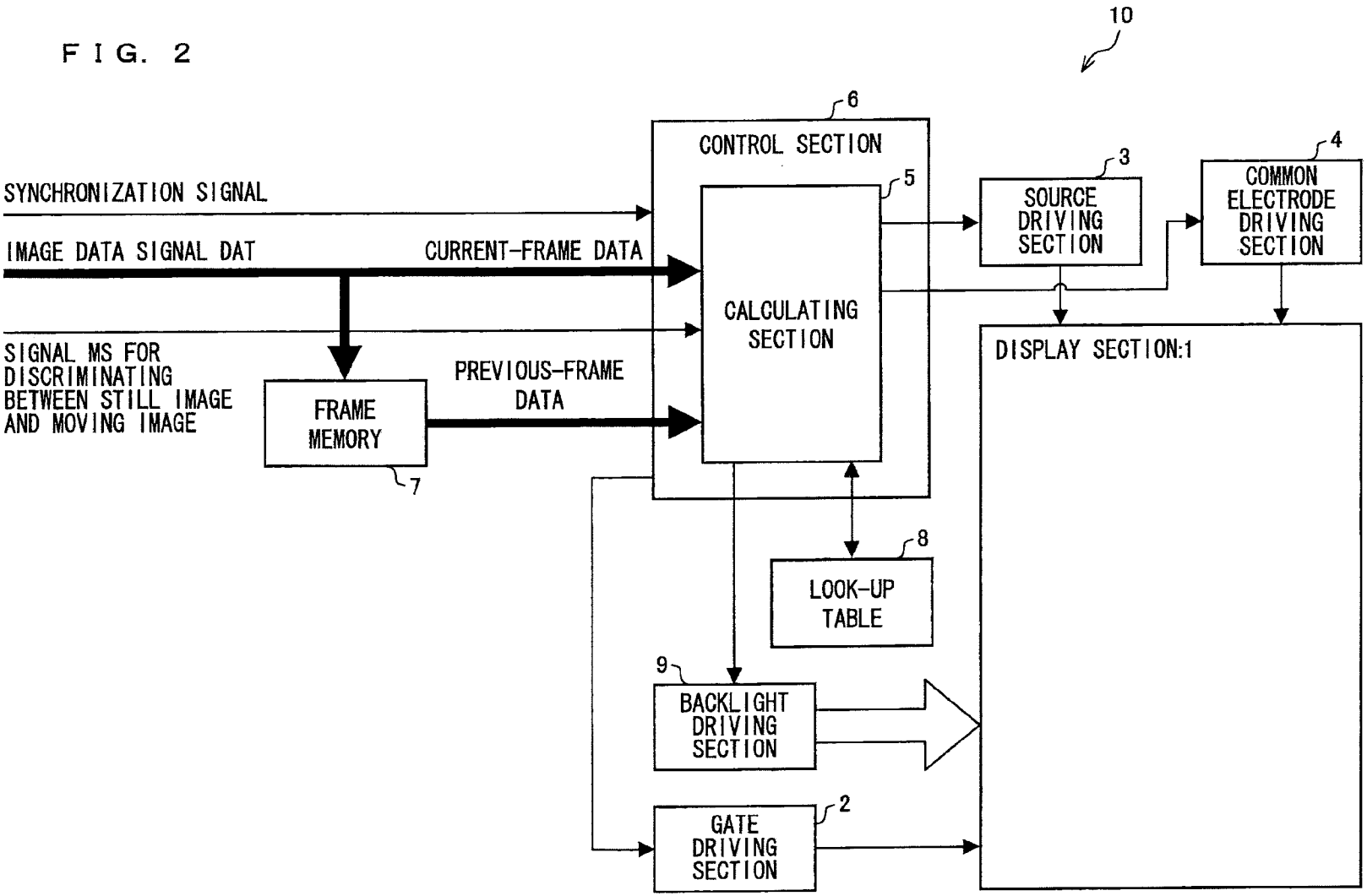
FIG. 2 is a block diagram showing an overall arrangement of the liquid crystal display apparatus.

For example, as shown in FIG. 2, an active matrix liquid crystal display apparatus 10 of the present embodiment includes: a display section 1, a gate driving section 2, a source driving section 3, a common electrode driving section 4, a control section in which a calculating section 5 is provided, a frame memory 7, a look-up table 8, and a backlight driving section 9.

Although not fully shown in the figure, the display section 1 includes e scanning signal lines that are parallel to one another, f data signal lines that are parallel to one another, and pixels arrayed in a matrix manner. Each of the pixels is formed in a region enclosed by two adjacent scanning signal lines and two adjacent data signal lines.

The gate driving section 2 sequentially generates, in accordance with a gate clock signal and a gate start pulse each outputted from the control section 6, scanning signals that are to be supplied to scanning signal lines connected to pixels arrayed in each line.

The source driving section 3 samples an image data signal DAT in accordance with a source clock signal and a source start pulse each outputted from the control section 6, and outputs the obtained image data to data signal lines connected to pixels arrayed in each line.

The control section 6 is a circuit that generates, in accordance with a synchronization signal inputted thereto, the image data signal DAT, and a signal MS for discriminating between an moving image and a still image, various control signals for controlling operation of the gate driving section 2 and source driving section 3, and then outputs the control signals. As described above, examples of the control signals that are outputted from the control section 6 include the clock signal, the start pulse, and the image data signal DAT.

The calculating section 5 of the control section 6 converts the image data signal DAT when a moving image is displayed. The data conversion in the calculating section 5 is performed, for example, in accordance with data stored in the look-up table 8. Note that the calculating section 5 can be integrated with a driver such as the source driving section 3 or the gate driving section 2. Further, in cases where an external control IC is provided, the calculation section 5 can also be part of that control IC. Furthermore, the calculating section 5 can also be incorporated as a monolithic circuit into the display section 1. Further, according to the foregoing example, the calculating section 5 is provided in the control section 6. However, the present invention is not limited to this. It is also possible to perform a gradation process or the after-mentioned black process by disposing only the calculating section 5 in front of the control section 6.

On this occasion, the control section 6 receives a signal MS for discriminating between a moving image and a still image, thereby determining whether or not a moving image is displayed. In case of a still image, the control section 6 becomes able to carry out a display without making a gradation transition, and therefore becomes able to carry out a display without impairing γ characteristic, luminance, and contrast at all.

Such a signal MS for discriminating between a moving image and a still image can be realized, for example, by preparing a single terminal for an input signal in such a way that a high input signal indicates a moving image and a low input signal indicates a still image. That is, for example, it is possible that: the control section 6 receives, from a user set, a 1-bit signal that represents a moving image or a still image, thereby discriminating between a moving image and a still image.

Note that the discrimination between a moving image and a still image is not necessarily limited to this. For example, a command that represents a moving image or a still image may be received. Furthermore, it is possible to employ a discriminating method including the steps of: storing, in the frame memory 7, data corresponding to the previous frame that came immediately before the current frame; comparing the data with data corresponding to the current frame; and setting a moving-image mode when there is a difference between the data corresponding to the previous frame and the data corresponding to the current frame. Examples of the difference between the data corresponding to the previous frame and the data corresponding to the current frame include a difference of not less than a predetermined gradation and a difference of not less than a certain number of pixels.

Meanwhile, each of the pixels of the display section 1 includes a switching element such as a TFT (thin film transistor), a liquid crystal capacitor, and the like. In such a pixel, the TFT has a gate connected to a scanning signal line and has a drain and source via both of which one electrode of the liquid crystal capacitor is connected to a data signal line, and the other electrode of the liquid crystal capacitor is connected to a common electrode wire that is common to all the pixels. The common electrode driving section 4 supplies a voltage that is to be applied to this common electrode wire.

In the liquid crystal display apparatus 10, the gate driving section 2 selects a scanning signal line, and an image data signal DAT to be sent to a pixel corresponding to a combination of the scanning signal line being selected and each of the data signal lines is outputted to that data signal line by the source driving section 3. With this, the image data are respectively written in pixels connected to the scanning signal line. Similarly, the gate driving section 2 sequentially selects the scanning signal lines, and the source driving section 3 outputs image data to the data signal lines. As a result, the image data are respectively written in all the pixels of the display section 1, so that the display section 1 displays an image corresponding to the image data signal DAT.

On this occasion, the image data that are sent from the control section 6 to the source driving section are transmitted as an image data signal DAT in a time-dividing manner. When the image data are sent to the source driving section 3 via the control section 6, the current-frame data is stored in the frame memory 7. The one-frame data stored in the frame memory 7 is used to be compared with the previous-frame data when the calculating section 5 performs overdrive driving.

The source driving section 3 extracts various image data from the image data signal DAT at timings based on a source clock signal, an inversion source clock signal, and a source start pulse each serving as a timing signal, and then outputs the image data to the respective pixels.

Incidentally, for example, it is known that the response speed of a normally black system becomes low in a transition from a low gradation to a higher gradation. This causes a problem when a moving image is displayed. The response speed becomes low especially when both of the gradations (i.e., the gradation before change and the gradation after change) are at low levels. On the other hand, it is known that the response speed of a normally white system becomes low in a transition from a high gradation to a lower gradation or especially when both of the gradations are at high levels.

Figure 13:
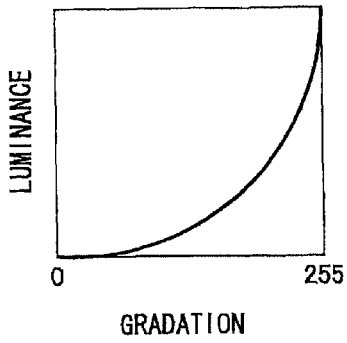
FIG. 13 Conventional Art
FIG. 13 is a characteristic diagram showing a normal gradation-luminance relationship of the liquid crystal display apparatus.

In view of this, the present embodiment achieves an improvement in response speed by a first method of displaying a still image in accordance with a conventional normal gradation-luminance curve shown in FIG. 13 and displaying a moving image without using a level at which the response speed becomes low.

Specifically, assume, for example, that when the total number of gradations is 256, a normally black system is slow in responding to applied voltages 0V to 31V respectively corresponding to gradations 0 to 31. In this case, the applied voltages V0 to V31 respectively corresponding to the 32 gradations are raised to the same voltage as an applied voltage V32 corresponding to a gradation 32.

Figure 1:
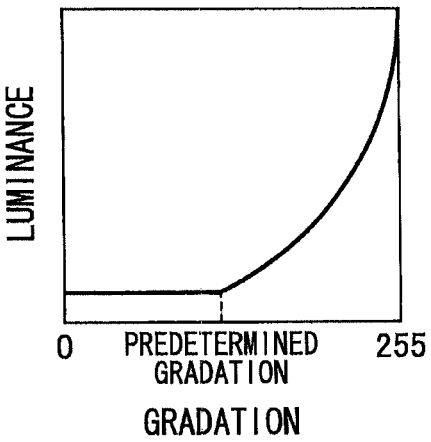
FIG. 1 shows an embodiment of a method of the present invention for driving a liquid crystal display apparatus, and is a characteristic diagram showing a gradation-luminance relationship formed when a low-gradation region is eliminated at the time of displaying a moving image.
Figure 3:
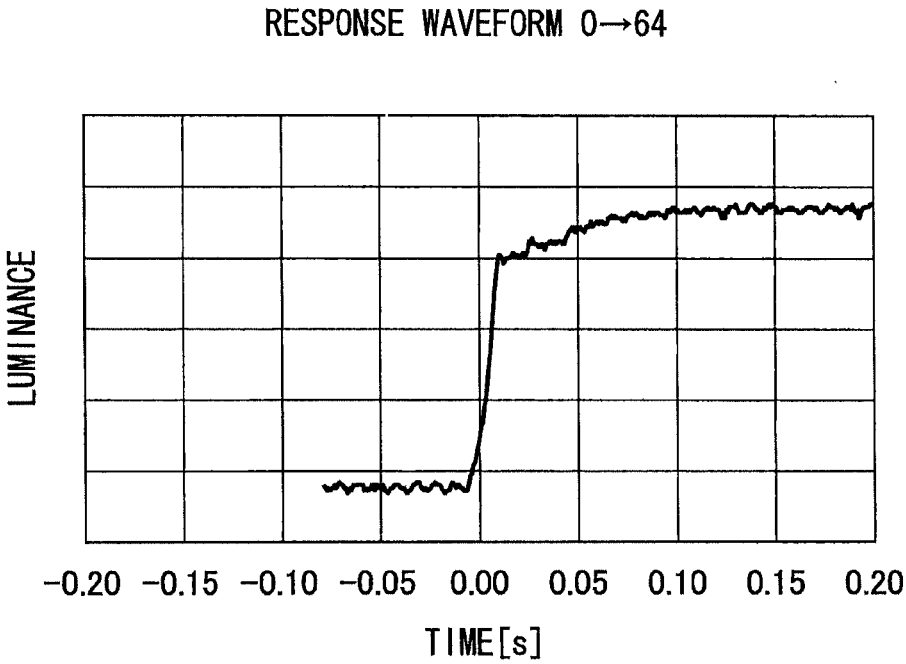
FIG. 3 is a waveform chart showing a response waveform obtained when a low-gradation region is eliminated at the time of displaying a moving image in the liquid crystal display apparatus and of performing overdrive driving.

This results in such a gradation-luminance relationship as shown in FIG. 1. In addition, the performance of overdrive driving makes it possible to, as shown in FIG. 3, achieve a very satisfactory improvement in response speed at which a moving image is displayed. Further, since the other gradation applied voltages (V32 to V255) are not changed, the γ characteristic of the display section 1 is not changed, so that it is possible to maintain a good display.

Figure 4:
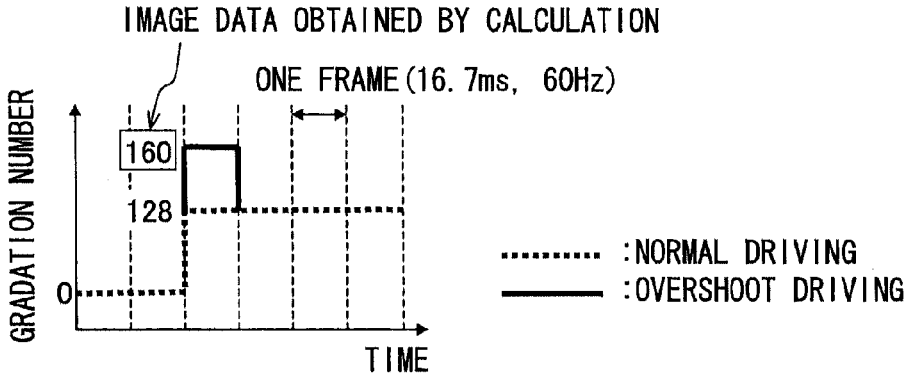
FIG. 4(*a*) is a diagram showing a relationship between time and gradation data that are to be written in pixels when overdrive driving is performed such that the gradation 0 (black) in the previous frame is changed to a gradation 128 (intermediate gradation) for the current frame.
Figure 4:
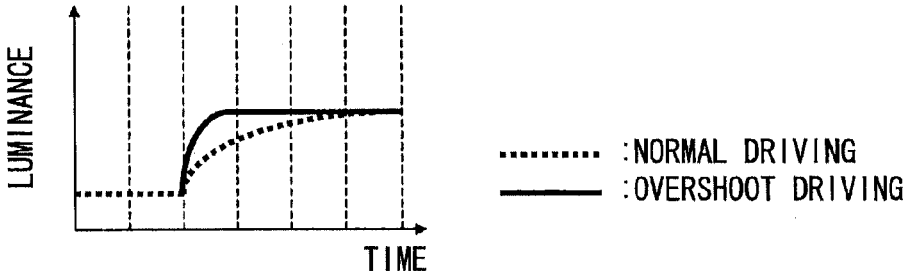

The following explains overdrive driving. As shown in FIG. 4(*a*), the overdrive driving is a driving method of applying correction data derived from a relationship formed by making a comparison between data corresponding to the current frame and data corresponding to the one frame that came immediately before the current frame. To be more accurate, the relationship refers to "to apply such a gradation as to make a difference bigger than the difference between the gradation of the one frame that came immediately before the current frame (such a frame being hereinafter referred to as 'previous frame') and the gradation of data inputted to the current frame". For example, the overdrive driving is such driving that in cases where the gradation of the previous frame is V0 and the gradation of data inputted to the current frame is V128, the gradation V160 is applied. The application of such a gradation value makes it possible to obtain a liquid-crystal response waveform, shown in FIG. 5(*b*), which has a sharp rising edge.

As described above, the overdrive driving is a driving method of applying an unusual voltage only to a frame that comes immediately after a change in gradation. Further, the amount of change in voltage is changed in accordance with the relationship between a gradation before change and a gradation after change. Therefore, the luminance at a gradation is not steadily changed to a certain value.

Figure 5:
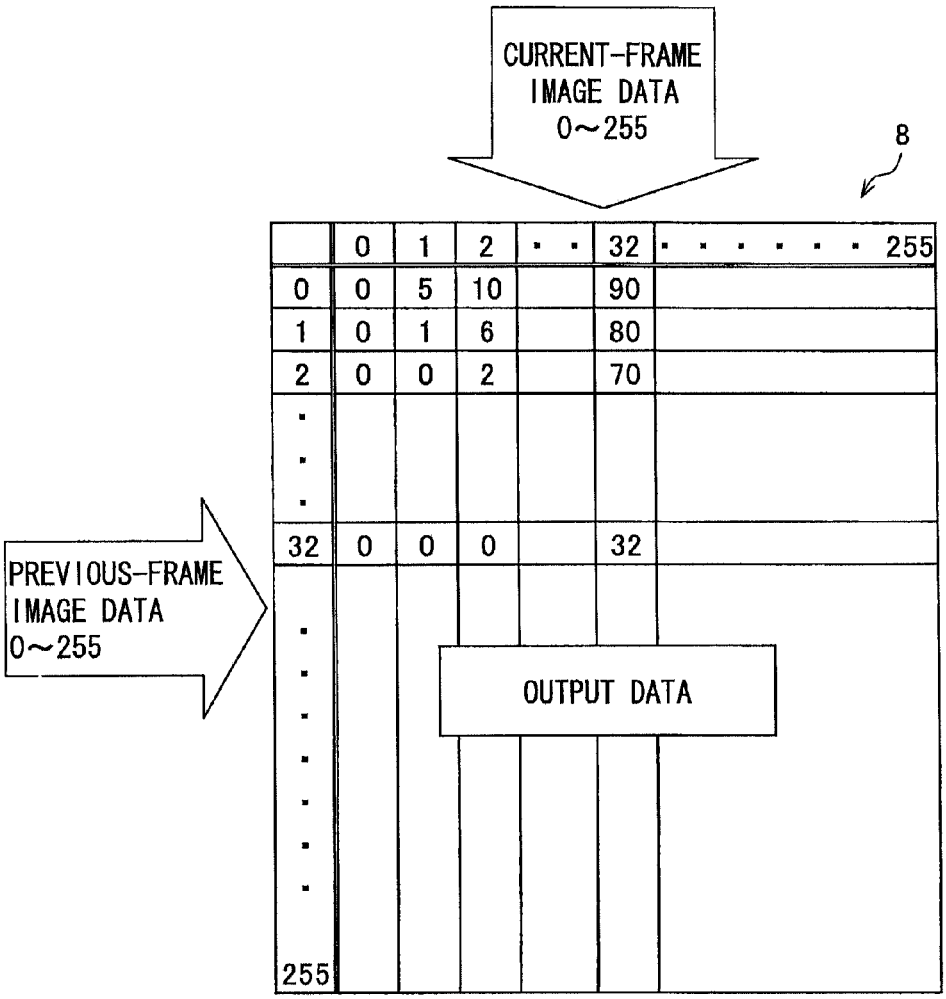
FIG. 5 is a diagram showing a look-up table, in which overdrive driving output data are stored in correspondence with the gradation values of previous-frame image data and the gradation values of current-frame image data, of the liquid crystal display apparatus.

A gradation value for applying a voltage higher than a normally desired gradation applied voltage for the purpose of the overdrive driving, i.e., a gradation value that is found in accordance with the relationship between a gradation before change and a gradation after change can be obtained by calculation. However, the present invention is not necessarily limited to this. As shown in FIG. 5, such a gradation value can be calculated with use of the look-up table 8.

Incidentally, the luminance-gradation characteristic of FIG. 1 causes a range of luminances that can be displayed to be narrower than when normal display driving is performed, thereby causing deterioration in display quality. That is, gradations other than those equalized are normal. Therefore, a good γ characteristic is exhibited. However, the number of gradations is reduced to the extent of the equalization.

In view of this, the present embodiment smoothens the luminance-gradation characteristic in the following manner.

For example, on the assumption that the total number of gradations is 256 and the predetermined gradation is m, the present embodiment sorts n gradations into a range of voltages for gradations (n−m) by a second method.

Specifically, without using applied voltages respectively corresponding to gradations of less than the predetermined gradation m (m being an integer of not less than 1), (n−m) types of gradation are partially overlapped so that n gradations are obtained, and then the n gradations are sorted into a range of (i) an applied voltage corresponding to the predetermined gradation m to (ii) an applied voltage corresponding to a gradation (n−1). Then, such overdrive driving is performed that when an applied voltage for a gradation k (k being an integer of 0 to (n−1)) obtained by the sorting is applied, a voltage higher than a voltage that is normally applied for the k gradation is applied.

Figure 6:
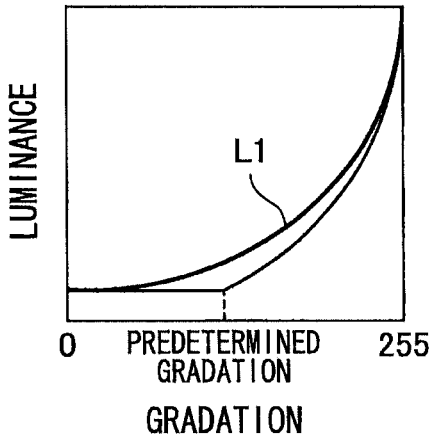
FIG. 6 is a characteristic diagram showing a gradation-luminance relationship formed when n gradations are sorted into a range of voltages for gradations (n−m) or when the same range of applied voltages is redivided in accordance with n gradations at the time of displaying a moving image in the liquid crystal display apparatus.

This results in a luminance-gradation curve L1 shown in FIG. 6. That is, this luminance-gradation curve L1 covers a gradation range of 1 to 255; therefore, the display quality becomes better than before. However, since the n gradations are expressed in a pseudo manner with use of the remaining (n−m) gradations, the number of gradations is reduced. Further, the γ characteristic is such that a white floating phenomenon occurs. However, the second method is easily carried out because it can be realized by using a conventional liquid crystal driver without modification.

Meanwhile, for example, the present embodiment can redivide the same range of applied voltages in accordance with n gradations by a third method. Specifically, without using gradations of less than the predetermined gradation m (m being an integer of not less than 1), a total of n (n being an integer of more than m) types of gradation are redivided within a gradation range of m to n−1. Then, such overdrive driving is performed that when an applied voltage for a gradation k (k being an integer of 0 to (n−1)) obtained by the redivision is applied, a voltage higher than a voltage that is normally applied for the k gradation is applied.

Although the third method is more complicated than the second method, the third method yields a smoother gradation display. That is, since the gradations are reset, all the n gradations can be expressed. However, the γ characteristic is such that a white floating phenomenon occurs. Further, when the third method is carried out, a conventional liquid crystal driver cannot be used without modification. This is because the liquid crystal driver needs to be arranged such that gradation voltages can be changed.

Further, the elimination of these low gradations and the performance of overdrive driving make it possible to obtain a response waveform, such as the one shown above in FIG. 3, which has no angular response (two-step response) portion and has a sharp rising edge.

FIG. 7 specifically shows gradations and liquid crystal applied voltages with respect to each of the first to third methods. As shown in FIG. 7, all the methods have the same liquid crystal applied voltage when the original data corresponds to a gradation 0; however, they differ from one another in subsequent processes.

Incidentally, in cases where the gradations are adjusted by the aforementioned processes, the γ characteristic is changed. As a result, an entirely whitish image is obtained in case of a normally black system, and an entirely dark image is obtained in case of a normally white system.

In such a case, it is preferable, for example, to perform light control with use of a backlight by a fourth method (such light control being hereinafter referred to as "backlight light control"). This backlight light control is performed by the backlight driving section 9 of FIG. 2. The following explains the backlight light control with reference to a case where the backlight light control is performed in a normally black system.

Figure 8:
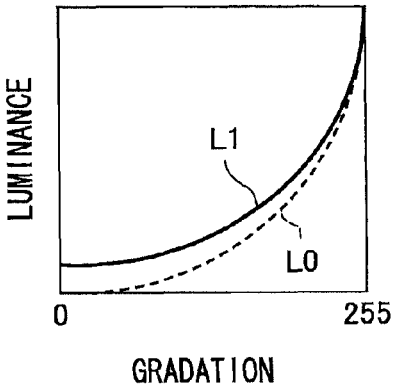
FIG. 8 is a characteristic diagram showing, in contrast to a normal gradation-luminance relationship, a gradation-luminance relationship formed when n gradations are sorted into a range of voltages for gradations (n−m) or when the same range of applied voltages is redivided in accordance with n gradations at the time of displaying a moving image in the liquid crystal display apparatus.
Figure 9:
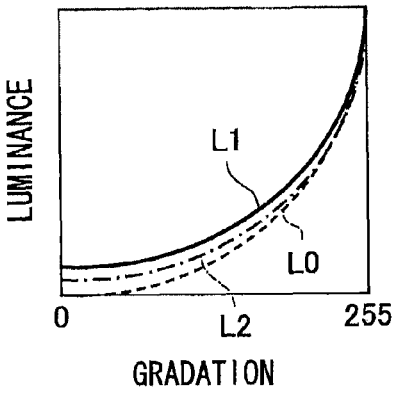
FIG. 9 is a characteristic diagram showing a gradation-luminance relationship formed when a backlight adjustment is made at the time of displaying a moving image in the liquid crystal display apparatus.

That is, the process of rearranging gradations causes such a change in gradation-luminance characteristic that results in a luminance-gradation curve L1 indicated by a solid line in FIG. 8. FIG. 8 indicates a normal luminance-gradation curve L0 by a dotted line.

Therefore, a reduction in backlight luminance makes it possible to prevent an image from being entirely whitish. In this case, the backlight luminance can be adjusted so that, as shown by a luminance-gradation curve L2 indicated by a dashed line in FIG. 9, the average values of the luminances of all the gradations become equal. Further, the present invention is not limited to this. For example, it is possible to make an adjustment such that the luminances of specific gradations become equal.

Further, although the foregoing explanation assumes that a normally black system is employed, the present invention is not necessarily limited to this. A normally white system can also be employed in the same line of thought.

That is, it is known that the response speed of a normally white system becomes low in a transition from a high gradation to a lower gradation or especially when both of the gradations are at high levels. This causes a problem when a moving image is displayed.

Therefore, the response speed can be improved by carrying out a display without using a level at which the response speed becomes low.

Specifically, for example, in cases where the display section 1 having a total of 256 gradations is slow in responding to gradations V255 to V241, applied voltages respectively corresponding to the 15 gradations are raised to the same voltage as the gradation V240. This results in a great improvement in response characteristic.

Further, in cases where the other gradations (V0 to V240) are not changed, the γ characteristic of the display section 1 is not changed, so that it is possible to maintain a good display.

As described above, the method of the present embodiment for driving the liquid crystal display apparatus 10 is characterized as follows. That is, for example, in case of a normally black system, a low voltage can be applied as a gradation output when a still image is displayed. However, when a moving image is displayed, only a gradation that is higher by a predetermined voltage is used instead of that low voltage.

That is, a liquid crystal driving circuit generates an applied voltage corresponding to each gradation, but each gradation voltage is basically fixed. According to Japanese Unexamined Patent Application Publication No. 78129/2004 (Tokukai 2004-78129), a gradation voltage is set in advance to be higher by a predetermined voltage. On the other hand, according to the present embodiment, a gradation voltage is set to be at the same level as a normal voltage, and a gradation of not more than a predetermined voltage is not used when a high-speed response is required. This makes it possible to easily realize a high-speed response. Further, when a high-speed response is not required, a gradation of not more than a predetermined voltage can be used. This makes it possible to carry out a display with higher contrast (with higher luminance in some cases).

Further, the application of the technique of the present embodiment to a conventional driving circuit as well as a liquid crystal display apparatus, having such a driving circuit, which carries out a display by using a portion of not less than a predetermined voltage makes it possible to realize a high-speed response without causing a change in the driving circuit.

Further, for gradations other than the gradations whose driving voltages have been uniformed, normal driving is performed. This results in a display with a good gradation γ characteristic.

Furthermore, a moving image and a still image are discriminated from each other in accordance with some sort of signal that represents a moving image or a still image, and in case of a still image, normal driving is performed for all the gradations. This makes it possible to carry out a display without impairing γ characteristic, luminance, and contrast at all.

Further, an increase in power can be prevented by, at the time of displaying a still image, stopping driving a memory for overdrive, driving a calculating circuit, and supplying power to the memory.

[Embodiment 2]

Another embodiment of the present embodiment will be described below with reference to FIGS. 10 and 11. Arrangements other than those described in the present embodiment are the same as in Embodiment 1. Further, for convenience of explanation, members having the same functions as those shown in the drawings of Embodiment 1 are given the same reference numerals, and will not be described below.

Embodiment 1 rearranges the gradation range; however, the present invention is not particularly limited to this. As shown in FIG. 10, the applied voltages can be simply shifted. This makes it possible to obtain a wide-range luminance characteristic.

Incidentally, this method of simply shifting the applied voltages causes an increase in luminance of all the gradations. Therefore, as with Embodiment 1, the γ characteristic is changed. As a result, an entirely whitish image is obtained in case of a normally black system, and an entirely dark image is obtained in case of a normally white system.

In such a case, it is preferable to perform backlight light control as with Embodiment 1. This backlight light control is performed by the backlight driving section 9 of FIG. 2. The following explains the backlight light control with reference to a case where the backlight light control is performed in a normally black system.

Figure 10:
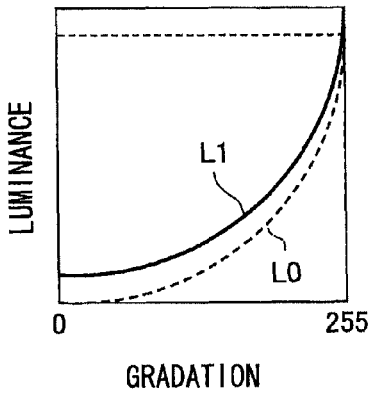
FIG. 10 shows another embodiment of a method of the present invention for driving a liquid crystal display apparatus, and is a characteristic diagram showing a gradation-luminance relationship formed when an applied voltage is shifted.
Figure 11:
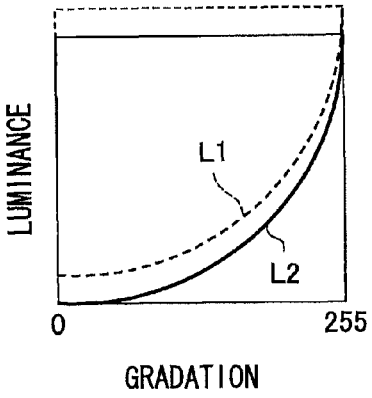
FIG. 11 is a characteristic diagram showing a gradation-luminance relationship formed when a backlight adjustment is made at the time of displaying a moving image according to the method for driving a liquid crystal display apparatus.
Figure 12:
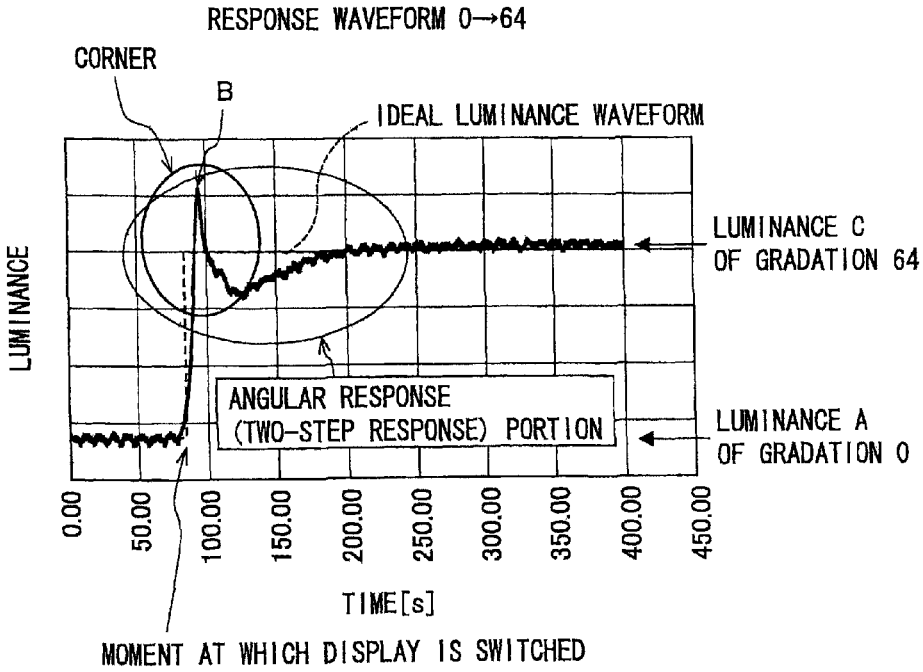
FIG. 12 Conventional Art
FIG. 12 shows a conventional method for driving a liquid crystal display apparatus, and is a waveform chart showing overdrive driving.

That is, the process of simply shifting the applied voltages causes such a change in gradation-luminance characteristic that results in a luminance-gradation curve L1 indicated by a solid line in FIG. 10. FIG. 10 indicates a normal luminance-gradation curve L0 by a dotted line. Note that FIG. 10 shows a curve that has been simply shifted. However, strictly speaking, because the vertical axis represents the converted luminance, the curve L1 is not obtained by simply shifting the curve L0.

As described above, a reduction in backlight luminance makes it possible to prevent an image from being entirely whitish. Specifically, an adjustment of backlight luminance makes it possible that, as shown in FIG. 11, the gradation-luminance characteristic exhibited when a moving image is displayed is equal to the gradation-luminance characteristic exhibited when a still image is displayed.

Further, although the foregoing explanation assumes that a normally black system is employed, the present invention is not necessarily limited to this. A normally white system can also be employed in the same line of thought.

As described above, according to the method of the present invention for driving the liquid crystal display apparatus, it is preferable that applied voltages respectively corresponding to predetermined gradations m to (n−1) for use in displaying a moving image be identical to still-image applied voltages respectively corresponding to predetermined gradations m to (n−1) for use in displaying a still image.

With this, as applied voltages respectively corresponding to predetermined gradations m to (n−1), still-image applied voltages respectively corresponding to predetermined gradations m to (n−1) for use in displaying a still image are used. This makes it possible to use a gradation-luminance characteristic that is exhibited when a still image is displayed, so that there is no change in display quality.

Further, according to method of the present invention for driving the liquid crystal display apparatus, it is preferable that when the liquid crystal display apparatus employs a normally black system, the applied voltages respectively corresponding to the gradations of less than the predetermined gradation m should not be used.

This makes it possible to prevent an angular response in overdrive driving.

Further, according to the method of the present invention for driving the liquid crystal display apparatus, it is preferable that when all the gradations consist of gradations 0 (black) to 255 (white) and the liquid crystal display apparatus employs a normally black system, the predetermined gradation m be defined as $1 \leq m \leq 32$.

This brings about an effect of improving the response speed of a normally black system when the predetermined gradation m is defined as $1 \leq m \leq 32$.

Further, according to the method of the present invention for driving the liquid crystal display apparatus 10, it is preferable that when all the gradations consist of gradations 0 (black) to 255 (white) and the liquid crystal display apparatus employs a normally black system, the predetermined gradation m be defined as $9 \leq m \leq 15$.

This brings about an effect of improving the response speed of a normally black system when the predetermined gradation m is defined as $9 \leq m \leq 15$, and also achieves a reduction in deterioration of contrast and a reduction in influence of deterioration in image quality. For example, in case of a display whose gradation has a γ characteristic adjusted to be 2.2 and whose initial contrast is not less than 200, a reduction in contrast at $9 \leq m \leq 15$ is kept to not more than 30%.

Further, according to the method of the present invention for driving the liquid crystal display apparatus, it is preferable to adjust backlight luminance in order to prevent a screen from being entirely whitish.

Such an adjustment of backlight luminance makes it possible to prevent a screen from being entirely whitish when the applied voltages are uniformly shifted.

Further, according to the method of the present invention for driving the liquid crystal display apparatus, it is preferable that applied voltages respectively corresponding to predetermined gradations 0 to q−1 for use in displaying a moving image be identical to applied voltages respectively corresponding to predetermined gradations 0 to q−1 for use in displaying a still image.

Further, according to the method of the present invention for driving the liquid crystal display apparatus, it is preferable that when the liquid crystal display apparatus employs a normally white system, the applied voltages respectively corresponding to the gradations of not less than the predetermined gradation q should not be used.

Further, according to the method of the present invention for driving the liquid crystal display apparatus, it is preferable that when all the gradations consist of gradations 0 (black) to 255 (white) and the liquid crystal display apparatus employs a normally white system, the predetermined gradation q be defined as $224 \leq q \leq 255$.

Further, according to the method of the present invention for driving the liquid crystal display apparatus, it is preferable that when all the gradations consist of gradations 0 (black) to 255 (white) and the liquid crystal display apparatus employs a normally white system, the predetermined gradation q be defined as $241 \leq q \leq 247$.

Further, according to the method of the present invention for driving the liquid crystal display apparatus, it is preferable to adjust backlight luminance in order to prevent a decrease in luminance of an entire screen.

All this makes it possible to provide a method for driving a liquid crystal display apparatus 10, regardless of whether the liquid crystal display apparatus 10 employs a normally black system or a normally white system, which method makes it possible to prevent deterioration in display quality of both a still image and a moving image and to achieve an improvement in response speed at which a moving image is displayed.

Further, according to the method of the present invention for driving the liquid crystal display apparatus, it is preferable to adjust an applied voltage in accordance with a γ characteristic so that the γ characteristic is improved.

This achieves an improvement in γ characteristic. Specifically, such a gradation that the γ characteristic is improved can be picked up by calculation based on the transmittance characteristic of liquid crystals with respect to an applied voltage.

Further, according to the method of the present invention for driving the liquid crystal display apparatus 10, it is preferable to discriminate between a still image and a moving image in accordance with a signal for discriminating between a still image and a moving image.

This makes it possible to provide a method for driving a liquid crystal display apparatus 10, which method makes it easy to discriminate between a still image and a moving image by acquiring a signal for discriminating between a still image and a moving image. When a still image is displayed, this method makes it possible to perform normal driving for all gradations, thereby making it possible to display the still image without impairing γ characteristic, luminance, and contrast. When a moving image is displayed, this method makes it possible to achieve an improvement in response speed.

Further, according to the method of the present invention for driving the liquid crystal display apparatus, it is preferable to suspend overdrive driving when a still image is displayed.

This makes it unnecessary to increase the response speed when a still image is displayed, and makes it possible to achieve a reduction in power consumption by suspending overdrive driving.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be used as a method for driving a liquid crystal display apparatus such as an active-matrix display.

The invention claimed is:

1. A method for driving a liquid crystal display apparatus, comprising the steps of:

when a still image is displayed, outputting applied voltages to pixels, the applied voltages respectively corresponding to a total of n (n being an integer of not less than 4) types of gradation 0 to (n−1);

when a moving image is displayed, without using applied voltages respectively corresponding to gradations of less than a predetermined gradation m ($1 \leq m \leq (n-2)$), overlapping (n−m) types of gradation partially so that n gradations are obtained and then sorting the n gradations into a range of (i) an applied voltage corresponding to the predetermined gradation m to (ii) an applied voltage corresponding to the gradation (n−1); and when an applied voltage corresponding to a gradation k (k being an integer of 0 to (n−1)) obtained by the sorting is applied to the pixels, performing overdrive driving with respect to the total of n types of gradation.

2. The method as set forth in claim 1, wherein when the liquid crystal display apparatus employs a normally black system, the applied voltages respectively corresponding to the gradations of less than the predetermined gradation m are not used.

3. The method as set forth in claim 1, wherein n is greater than or equal to 8 and when all the gradations consist of gradations 0 (black) to (n−1) (white) and the liquid crystal display apparatus employs a normally black system, the gradation m is defined as $1 \leq m \leq (n/8)$.

4. The method as set forth in claim 3, wherein n is 256.

5. The method as set forth in claim 1, wherein when n is greater than or equal to 32 and all the gradations consist of gradation 0 (black) to (n−1) (white) and the liquid crystal display apparatus employs a normally black system, the gradation m is defined as $$(n/32)+1m \leq \{(n/16)-1)\}.$$

6. The method as set forth in claim 5, wherein n is 256.

7. The method as set forth in claim 1, comprising the step of adjusting backlight luminance in order to prevent a screen from being entirely whitish.

8. The method as set forth in claim 1, comprising the step of discriminating between a still image and a moving image in accordance with a signal for discriminating between a still image and a moving image.

9. The method as set forth in claim 1, comprising the step of suspending overdrive driving when a still image is displayed.

* * * * *